US006567633B2

(12) United States Patent
Burdick et al.

(10) Patent No.: US 6,567,633 B2
(45) Date of Patent: May 20, 2003

(54) METHOD AND APPARATUS FOR REDUCING LATERAL MOTION OF A TRANSFER BELT OF A LASER PRINTER

(75) Inventors: Robert Leonard Burdick, Lancaster, KY (US); Mark Andrew Omelchenko, Lexington, KY (US); Stacy Marie Pargett, Richmond, KY (US); Harald Portig, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/965,884

(22) Filed: Sep. 28, 2001

(65) Prior Publication Data

US 2003/0063924 A1 Apr. 3, 2003

(51) Int. Cl.[7] ..... G03G 15/00
(52) U.S. Cl. ..... 399/165; 474/101; 474/122
(58) Field of Search ..... 399/162, 163, 399/165, 302, 308, 164; 198/806, 807, 808, 813, 816, 835; 474/101, 111, 112, 122, 140

(56) References Cited

U.S. PATENT DOCUMENTS 4,397,538 A * 8/1983 Castelli et al. ..... 399/165
4,626,095 A * 12/1986 Berger ..... 399/165
5,383,006 A * 1/1995 Castelli ..... 399/165
5,659,851 A * 8/1997 Moe et al. ..... 399/165
5,717,984 A * 2/1998 Wong ..... 399/165
5,903,805 A 5/1999 Ueda et al. ..... 399/165

* cited by examiner

*Primary Examiner*—Hoan Tran
(74) *Attorney, Agent, or Firm*—John A. Brady; John J. McArdle, Jr.; Frederick H. Gribbell

(57) ABSTRACT

An improved intermediate belt system (ITM module) is provided, which controls the lateral motion of the belt in the scan direction of an EP printer, without the use of edge reinforcements or other attachments added to the belt. The tracking system of this ITM module is passive, and maintains roll alignment/parallelism within a predetermined tolerance while also maintaining roll conicity-end flare to a predetermined maximum diametral variation over the roll to minimize the effect of external forces on the belt walk rate. The ITM module also provides angled tracking guides near the tension roll to control the lateral position of the belt; the position of these tracking guides is adjustable at time of manufacture to achieve the desired lateral belt position.

23 Claims, 5 Drawing Sheets

METHOD AND APPARATUS FOR REDUCING LATERAL MOTION OF A TRANSFER BELT OF A LASER PRINTER

TECHNICAL FIELD

The present invention relates generally to image forming equipment and is particularly directed to an intermediate transfer member (ITM) module of the type which limits the lateral movement of the ITM belt. The invention is specifically disclosed as an ITM module that passively limits lateral belt movement by controlling dimensional characteristics of certain components, and by providing angled tracking guides to further limit such lateral belt movement.

BACKGROUND OF THE INVENTION

When a belt is driven around a system of rollers in an electrophotographic (EP) printer, such as a laser printer, a lateral motion (i.e., in the scan direction) can occur in addition to the motion in the driven direction (i.e., in the process direction). Without intervention, it is likely that the belt will continue to move laterally, ultimately running off the ends of these rollers, thereby damaging the belt and ending the life of the belt module.

Conventional belt transport systems that control lateral belt motion by use of contoured rollers (crowned, saddled, etc.) are unable to be used on many EP printer belt systems. Contoured rollers can only be used with relatively elastic belts that are not damaged when forced to conform to a roller having a shape that is not purely cylindrical. (If the belt does not conform to the roller, the lateral motion is poorly controlled.) Due to the material properties of some belt modules in many EP printers, which typically are both stiff and fragile, contoured rollers cannot be used. Also, when used as a means to transport media or toner, contoured rollers can induce misregistration and transfer problems across the width of the image.

A number of current ITM belt modules use tracking systems that attach items directly to the belt, such as edge reinforcements (e.g., tape), and/or guiding geometry materials (e.g., elongated beads of material) which are used in conjunction with flanges and/or steps in the rollers to control the lateral motion of the belt. These "attachments" have typically comprised tape, and/or guiding strips, ridges, or "beads" of material (e.g., elongated beads of epoxy or another fluidic dispensable material, or strips of solid material) that are applied to the belt, usually on the inside of the belt in an EP printer. The belt is then allowed to move laterally against a flange or a stop. In one example, the tape allows the flange to exert enough force to counteract the lateral motion of the belt without damaging the belt edge. In another example, a thick "bead" of material is attached to the belt. The rollers then have appropriate steps or grooves to accommodate the bead. When the belt moves laterally, the bead comes into contact with the edge of the step/groove, which restricts the lateral motion.

The conventional methods described above have a number of drawbacks, as follows:

(1) Tape, beads, or any items attached directly to the belt are additional operations in the belt manufacturing process and so add cost and complexity to the belt.

(2) Many EP printer belt materials have surface properties that prevent adequate adhesion. It is then problematic and/or costly to obtain a belt, adhesive, and tape and/or bead combination which will last a sufficiently large number of revolutions, say 100,000 or more, without losing the bond and then damaging the system. Many material combinations will only last 30,000 to 60,000 revolutions. This is worsened when belt systems must be made smaller to limit the footprint of an EP printer. Such smaller modules incorporate one or more small diameter rollers, typically less than 18–20 mm in diameter, and/or reverse rollers that expose the belt to bidirectional bending. Small diameter rollers and reverse bending create more stress from flexure which then causes tape and/or beads to crack and peel from the belt, thereby limiting belt life to as few as 25,000 to 45,000 revolutions.

(3) If the lateral position of the belt is set by the belt's edge (e.g., with reinforcing tape and flanges), even small amounts of unevenness in the belt edge and tape edge location (e.g., 0.2 mm to 0.4 mm) can cause irregular lateral motion of the belt. This can cause skew disturbances in the registration between colors in single-pass color EP systems. This is also true of beads. The unavoidable lack of straightness or variations in the thickness and/or lateral location of the bead edge by, for example 0.2 mm to 0.4 mm, can cause skew or registration problems.

(4) Items applied to the belt can generate problems in cleaning residual toner or other development materials from the belt when using a blade cleaner. Tape creates an effective step change in thickness. The step can be minimized by cutting a step of the width and thickness of the tape into the rollers and any other belt supports. However, due to tolerances, the step in the roller/support and the width and thickness of the tape or bead on the belt rarely have the exact canceling effect necessary to create a truly smooth supporting surface underneath the belt as it passes under a cleaner blade, and a gap or step will still occur. Any step change in the supporting surface of the belt creates cleaning problems for a blade cleaner. For wide belt modules, this can be solved by only printing and cleaning on the area of the belt that is within the tape. However, this can significantly increase the width of the belt module and of the EP machine, and leaves the potential for toner contamination. When belt modules must decrease in size to allow an overall decrease in the EP printer size, the blade cleaner is forced to operate over the top of any tape or beads. With such a configuration, the use of tape or beads typically causes early cleaning failure, i.e., at 30,000 to 60,000 prints, rather than a more desirable 100,000 or more prints.

Yet another method of controlling lateral belt motion is through the use of active steering. This requires costly sensing and activation means, that is, one or more sensors and at least one actuator (e.g., an additional motor with control circuitry, or a mechanism actuated by belt position), as well as a large lateral movement range to initially determine the motion of the belt and to begin controlling the belt. Such systems can be implemented using mechanical, electrical, pneumatic, or other means. The capture range significantly increases the width of the machine, thereby driving up the cost and machine footprint.

In view of the problems associated with conventional belt systems in EP printers, it would be an improvement to provide a belt module for an EP printer that utilized a passive tracking technique without the use of attachments (i.e., tape or "beads") to the belt itself, while at the same time preventing the belt from excess lateral motion. Such a system could utilize a reliable low cost method to control the lateral motion of the belt, without use of edge reinforcements, or other auxiliary parts or treatments applied to the belt.

SUMMARY OF THE INVENTION

Accordingly, it is an advantage of the present invention to provide an ITM belt system that minimizes the lateral tendency of the belt by tightly controlling the roll alignment/parallelism.

It is another advantage of the present invention to provide an ITM belt system that minimizes the lateral tendency of the belt by minimizing the walk rate through use of an adjustment roll.

It is yet another advantage of the present invention to provide an ITM belt system having a characteristic of making the belt tracking position relatively insensitive to variations in the torque required to drive the belt system.

It is still another advantage of the present invention to provide an ITM belt system having the ability to control the lateral position of the belt without edge reinforcement and without the use of external actuators, which further allows residual toner to be effectively cleaned from the entire belt width, thereby allowing a smaller width for both the belt system and its EP machine.

It is a further advantage of the present invention to provide an ITM belt system having the ability to form a stable lateral belt position, through use of the angled tracking guides located near one of the rolls.

It is yet a further advantage of the present invention to provide an ITM belt system having the ability to form a stable lateral belt position, without the use of moving parts to control belt positioning.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a belt system having a passive lateral tracking system is provided, in which the system comprises: a continuous belt member which travels along a predetermined pathway that is formed by a plurality of rolls; at least one tracking guide that is positioned a predetermined distance from one of the plurality of rolls, wherein the at least one tracking guide tends to limit a lateral movement of the belt member as the belt travels along its predetermined pathway.

In accordance with another aspect of the present invention, a belt system having a passive lateral tracking system is provided, in which the system comprises: a continuous belt member which travels along a predetermined pathway that is formed by a plurality of rolls; and wherein at least two of the plurality of rolls are positioned such that their parallelism is held to a predetermined substantially small angular value, to minimize an effect of external forces on belt walk rate in a lateral direction.

In accordance with a further aspect of the present invention, a belt system having a passive lateral tracking system is provided, in which the system comprises: a continuous belt member which travels along a predetermined pathway that is formed by a plurality of rolls; and wherein at least one of said plurality of rolls exhibits a roll conicity/flare of a predetermined maximum diametral variation within a roll, along the entire width of the roll.

In accordance with still another aspect of the present invention, a belt system having a passive lateral tracking system is provided, in which the system comprises: a continuous belt member which travels along a predetermined pathway that is formed by a plurality of rolls; and wherein a position of one of the plurality of rolls is adjusted along a predetermined line so as to minimize the belt walk rate.

In accordance with yet a further aspect of the present invention, a method for controlling lateral movement of a belt member in a belt system is provided, in which the method comprises the steps of: (1) providing a belt system having a continuous belt member which travels along a predetermined pathway that is formed by a plurality of rolls; (2) controlling dimension tolerances of predetermined components of the system; (3) adjusting a position of a first of the plurality of rolls with respect to a second of the plurality of rolls, thereby tending to minimize a walk rate of the belt member as the belt member travels along its predetermined pathway; and (4) providing at least one tracking guide that is positioned a predetermined distance from one of the plurality of rolls, wherein the at least one tracking guide tends to limit the lateral movement of the belt member as the belt member travels along its predetermined pathway.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Figure 1:
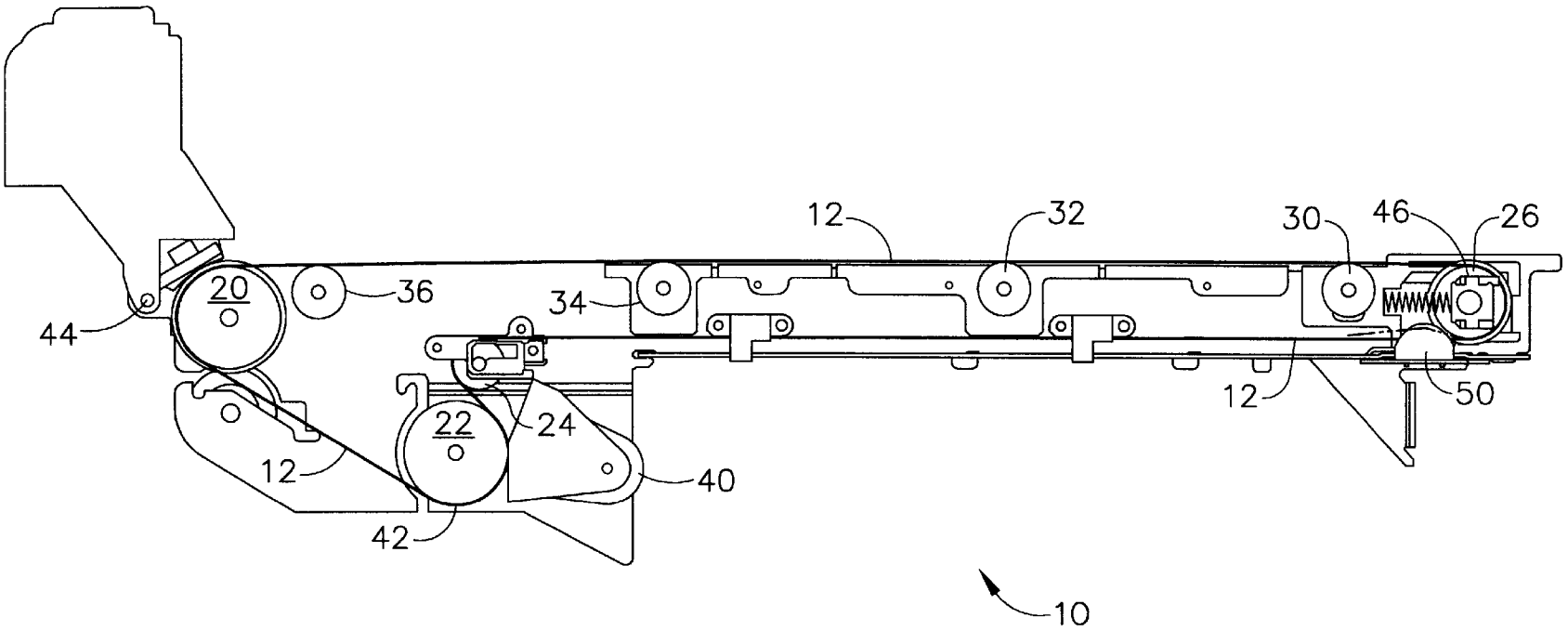
FIG. 1 is an elevational view in partial cross-section of an ITM belt module of an EP printer, as viewed from the side of the ITM module (or from the front of the printer), as constructed according to the principles of the present invention.

Reference will now be made in detail to the present preferred embodiment of the invention, an example of which is illustrated in the accompanying drawings, wherein like numerals indicate the same elements throughout the views.

The present invention allows the lateral motion of a belt of an EP printer (or other device requiring a similar belt, such as a scanner/copier) to be controlled without the use of tape, beads, or other items attached to the belt. There also is no need for the use of externally powered actuators such as motors or solenoids which actively move rolls or rollers (by use of active steering) to keep the belt in a proper lateral position, nor active tracking mechanisms.

The type of belt that is preferred for use in an EP printer exhibits a relatively long usage life. The present invention minimizes the lateral tendency of such a belt—throughout the life of a long-life belt module (e.g., 100,000 revolutions or more)—by tightly controlling the roll alignment (also referred to herein as "parallelism"). In a preferred embodiment, the roll alignment/parallelism is in the range of 0.04° to 0.10°, depending on the individual roll. The tight control of parallelism especially includes making the belt tracking position insensitive to variations in the torque required to drive the belt system.

The present invention also controls the conicity/end flare of certain rolls so that they maintain a substantially uniform diameter across their entire width.

The present invention also provides the ability to further minimize the lateral tendency of the belt, throughout the life of a long-life belt module (100,000 revolutions or more), by minimizing the walk rate (i.e., the lateral movement tendency of the belt) through use of an adjustable roll.

The present invention further provides the ability to control the lateral position of the belt—without edge reinforcement and without the use of active steering or other actuators—through use of angled tracking guides. The present invention also forms a substantially stable lateral belt position, through use of the angled guides, which is not affected by a variation in the belt edge straightness of at least 0.3 mm, for example.

The present invention includes the ability to maintain an acceptable lateral belt position, over the life of a long-life belt module (e.g., 100,000 revolutions or more), through use of the angled guides. It also allows for the ability to effectively clean residual toner from the entire belt width, thereby eliminating the possibility of toner contamination from an area unswept by the cleaner. This ability to effectively clean residual toner from the entire belt width allows a smaller width for both the belt module and EP machine.

One embodiment of the present invention is specifically aimed at ITM belts which transport toner from individual color stations (i.e., the color photoconductive drums which apply toner to the belt) to a "second" transfer point where the toner is again transferred, this time to print media such as paper sheet material. It will be understood that the principles of the present invention are also applicable to both multi-pass and single-pass color EP printing systems. It will be further understood that the principles of the present invention are applicable to belt modules (or systems) in which the belt does not transport toner, but instead transports paper past the individual color stations (i.e., the color photoconductive drums which apply toner to the paper).

As used herein, the terms "module" and "system" are essentially interchangeable, and refer to a belt subassembly for which it is desired to limit the lateral positioning of the belt itself. Such a subassembly could be removable in some EP printers, such that a modular replacement could be attached into the printer after a used "module" has been detached therefrom. Alternatively, the subassembly could be permanently affixed in the EP printer. Furthermore, the subassembly could transport paper, or it could instead transport toner (which is the typical situation of an "intermediate transfer member" of an EP printer).

The belt module of the present invention minimizes lateral movement of the belt without the use of additional moving parts, which should be an improvement over conventional belt modules that use added moving parts that could decrease reliability.

The tracking system disclosed herein consists of several aspects that work in unison to produce the result of controlling the belt position in an Intermediate Transfer Medium (ITM) module. As described below in detail, the preferred system includes: (1) controlling critical component tolerances, (2) a cam adjustment of the angle (which relates to parallelism) of one of the rollers (or "rolls"), and (3) an adjustable pair of guides.

The first two above aspects are mainly needed to limit the "walk rate" of the belt to a level low enough so as to not overpower the capability of the guides. The "walk rate" is defined herein as the distance the belt moves laterally per belt revolution. In the embodiment described below, walk rate is used to convey a level of lateral tendency of the belt. Finally, the guides determine the stable lateral position of the belt.

The roll alignment tolerances are an important consideration in an ITM module; the parallelism of the rolls to each other should be tightly controlled to ensure robustness of the system over different environments and operating conditions.

It has been demonstrated empirically that, in order to work acceptably in all expected environments and after accounting for wear and contamination over the life of the product, the allowable misalignments between roller axes of rotation preferably should be held to a range of 0.04° to 0.10°, depending on the individual roller.

Referring now to FIG. 1, an ITM belt module, generally designated by the reference numeral 10, is illustrated in a partial cross-section view from the side, which also is the "front" of the printer. The belt is designated by the reference number 12, and its shape is determined by several different rollers or rolls (the terms "roll" or "roller" are essentially equivalent in describing the present invention). These rolls are as follows: a drive roll 20, a back-up roll 22, a reverse roll 24, and a tension roll 26. In addition, there are four transfer rolls at 30, 32, 34, and 36, which each press the belt 12 against one of four photoconductive drums (not shown) that transfer toner of four different colors (one each) onto the belt 12.

FIG. 1 also depicts a cleaner at 40 and a "second-transfer location" at 42, where toner is transferred a second time, this time from the belt 12 onto a print medium such as paper sheet. The torque necessary to drive the ITM module varies over time as the drag characteristics change at the cleaner 40, the four first-transfer locations (at 30, 32, 34, and 36), the second-transfer location at 42, and in the bearings that allow the rollers to turn. It has been observed that this variation in drive torque affects the walk rate and lateral position of the belt 12. Controlling the parallelism of the rolls is an important aspect in limiting this effect, especially with regard to the back-up roll 22 and reverse roll 24.

It will be understood that the cleaner 40 preferably comprises a cleaner blade, however, other types of cleaning devices could certainly be used in lieu of a blade. For example, a cleaner brush could instead be used at the cleaner station (at the same or at a different location as that depicted for cleaner 40).

Another important aspect is roll conicity and end flare of certain individual rolls. The uniformity of diameter of each of three rollers (i.e., rolls 22, 24, and 26) preferably is specified to vary no more than 0.02 mm. It also is preferred that this specification be held over the entire width of the rollers, such that noticeable flare near the end of the roll would be considered unacceptable. The drive roll 20 preferably is specified so that its average diameter over multiple (e.g., 5) measurements at each position along the roll's width varies less than 0.02 mm.

It has been observed that, with a tapered roller, the walk rate of the belt 12 increased toward the larger diameter end. In addition, the above-noted changes in torque over time affect the lateral tendency and position of the belt. Controlling the taper and flare of the rolls is an important aspect in limiting these effects.

As noted above, to maintain a robust system over a reasonably long product life, it is best to hold the alignment of the rolls to a parallelism in the range of 0.04° to 0.10°. However, even with this precise level of roll alignment, the belt walk rates could be as high as 200 $\mu$m per revolution. To enable a "passive" tracking system that is robust against system noises, the tendency of the belt to walk laterally on the module should be limited to, for example, less than 10 $\mu$m per revolution. This low walk rate may not be achievable solely through attainable manufacturing tolerances. If not, other methodologies could be added to further reduce the walk rate.

The present invention provides a methodology that tends to minimize the walk rate to an acceptable level by adjusting the alignment of at least one of the rolls. As an initial matter, one of the rollers (e.g., the reverse roll 24) is chosen to have its angle made adjustable relative to the other rollers. Several factors are considered when making this choice. (1) Even though the drive roll 20 and the backup roll 22 both strongly affect the rate at which the belt walks axially off the rollers, these are not particularly good candidates for an adjustment because they are intimately involved in the core EP processes which have to do with color registration and transfer, and thus must have the control of their location tolerances be determined by those needs. (2) The tension roll 26 only weakly affects belt walk rate when changing the angle between its axis of rotation and a horizontal plane, thus it must be moved a large amount to have an adequate affect on walk rate. This motion produces a lot of twisting in the belt in the span where toner transfer from the PC drums to the belt occurs (i.e., at the transfer rolls 30, 32, 34, 36), and thereby causing transfer and misregistration difficulties. Changing the angle between this tension roll 26 and a vertical plane would require making the force applied to one end of its shaft for belt tensioning purposes larger than the force on the other end. Since the belt is stiff in its context, the level of such imbalance can be large enough to make one edge of the belt become slack or nearly slack. Thus the tension roll 26 also is not ideal as the adjustable roller.

The reverse roll 24 was chosen for adjustment because it was effective in controlling walk rate and did not produce pronounced negative effects. In the preferred embodiment, the rear end of the reverse roll 24 is adjusted in a horizontal direction. Through empirical testing and simulation, it has been determined that a substantially linear relationship exists between the initial belt walk rate and the adjustment necessary at the reverse roll 24. In a preferred embodiment, a 100 $\mu$m per revolution walk rate may be nulled-out by moving the reverse roll in a horizontal direction, by 0.18 mm.

Figure 3:
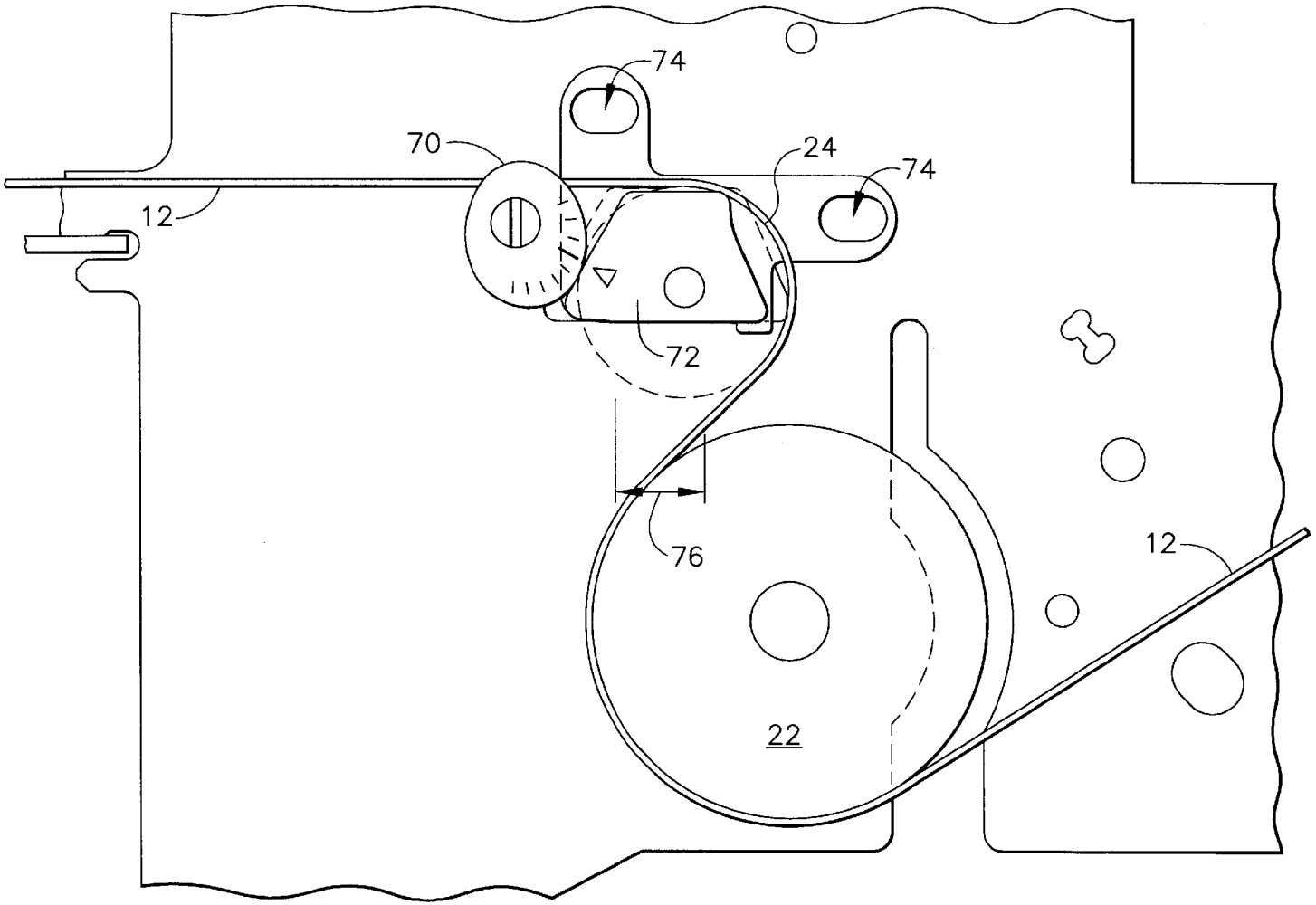
FIG. 3 is an elevational view of a portion of the ITM module of FIG. 1, showing a reverse roll adjustment cam in place near the reverse roll, as viewed from the rear of the printer.

The rear end (i.e., toward the back of the EP machine of FIG. 1) of the reverse roll has been selected for assembly reasons (as depicted in FIG. 3), however, the front end could instead be used with the same level of sensitivity. The horizontal direction was chosen for the linear direction of adjustment, because it could be implemented most easily. Other directions for making adjustments could instead have been chosen: for example, the direction approximately parallel to the bisector of the angle between the incoming and outgoing belt would have required slightly smaller adjustment distances for a given change in walk rate. Perpendicular to this direction, the adjustment was found to be substantially ineffective. Clearly there is a direction of maximum influence and a direction of minimum influence; such directions are dependent on the roll, and are further dependent on the characteristics of the system as a whole. It will be understood that the direction of adjustment could in fact consist of a curved path rather than a line, and perhaps will consist of a substantially linear path; pathways of any shape are contemplated by the inventors, and are encompassed by the teachings of the present invention.

The cam 70 that is used for the adjustment of the reverse roll 24 preferably is molded onto the rear ITM module frame plate at the same time as a number of other design features. This provides a very low cost way of providing a movable part without actually having to assemble it. It will be understood that other assembly or manufacturing methods could be used to construct the adjustable-position reverse roll without departing from the principles of the present invention. Moreover, the precise geometry and configuration of the adjustable parts could easily be modified, again without departing from the principles of the present invention.

The cam 72 that is used for the adjustment of the reverse roll 24 preferably is molded onto the rear ITM module frame plate at the same time as a number of other design features. This provides a very low cost way of providing a movable part without actually having to assemble it. It will be understood that other assembly or manufacturing methods could be used to construct the adjustable-position reverse roll without departing from the principles of the present invention. Moreover, the precise geometry and configuration of the adjustable parts could easily be modified, again without departing from the principles of the present invention.

The following section describes the walk rate reduction (adjustment) procedure:

(1) Once the belt module 10 has been assembled, the belt 12 is manually positioned to its nominal lateral location on the module, within a tolerance of about ±0.20 mm.

(2) The system 10 is set into a test fixture (not shown), which interfaces with the system 10 in a manner similar to an actual EP printer. The fixture, utilizing a similar drive interface as found in an EP printer, drives the roll system to cycle the belt around the rolls multiple times. The belt 12 is run for several revolutions: typical cycle values may range from 15 to 50 revolutions, with 25 being a preferred implementation.

(3) The lateral belt edge position is then measured over each of the belt revolutions traveled. A least squares fit of the data is calculated, the slope of which determines the walk rate of the belt 12. Several methods exist by which the belt edge position may be determined. It is important to note that the belt edge, due to straightness tolerance, may vary up to 0.30 mm, which could confound the belt edge measurement values in some test methodologies. The preferred approach is one of utilizing a home synchronization signal, which is created as a feature (e.g., a reflective piece of tape) placed on the belt 12 which will pass over a detection sensor (e.g., an optical sensor that receives reflective light from a light source). In this manner, the belt edge may be measured consistently in one area relative to the synchronization signal, removing the ambiguity of the belt edge straightness. The position measurements may be made by optical sensor, operator with a magnified view of the belt and reference edges, or alternatively by an automatic system controlled by software and a camera that provides input data. The testing system can be programmed to run with or without an operator interface.

(4) Once the walk rate has been determined in the previous step, the testing system will determine the adjustment (i.e., the cam position) that should be made for the reverse roll 24. The cam 70 is turned by that amount, thereby physically adjusting the reverse roll's location, thereby reducing the belt walk rate. The physical adjustment to the cam position can be made manually, or could be automated by providing a positioning actuator that is controlled by the testing system.

(5) The above procedure steps are repeated, until such time that the walk rate of the belt is less than 10 $\mu$m per revolution.

The acceptable maximum walk rate is determined by: (a) the amount of total lateral motion allowable, (b) the ability of the guides (discussed below) to counteract the walk rate, and (c) the ability of the belt material to withstand the stress induced by the guides. As noted above, a preferred implementation of the reverse roll adjustment is shown in FIG. 3.

Figure 2:
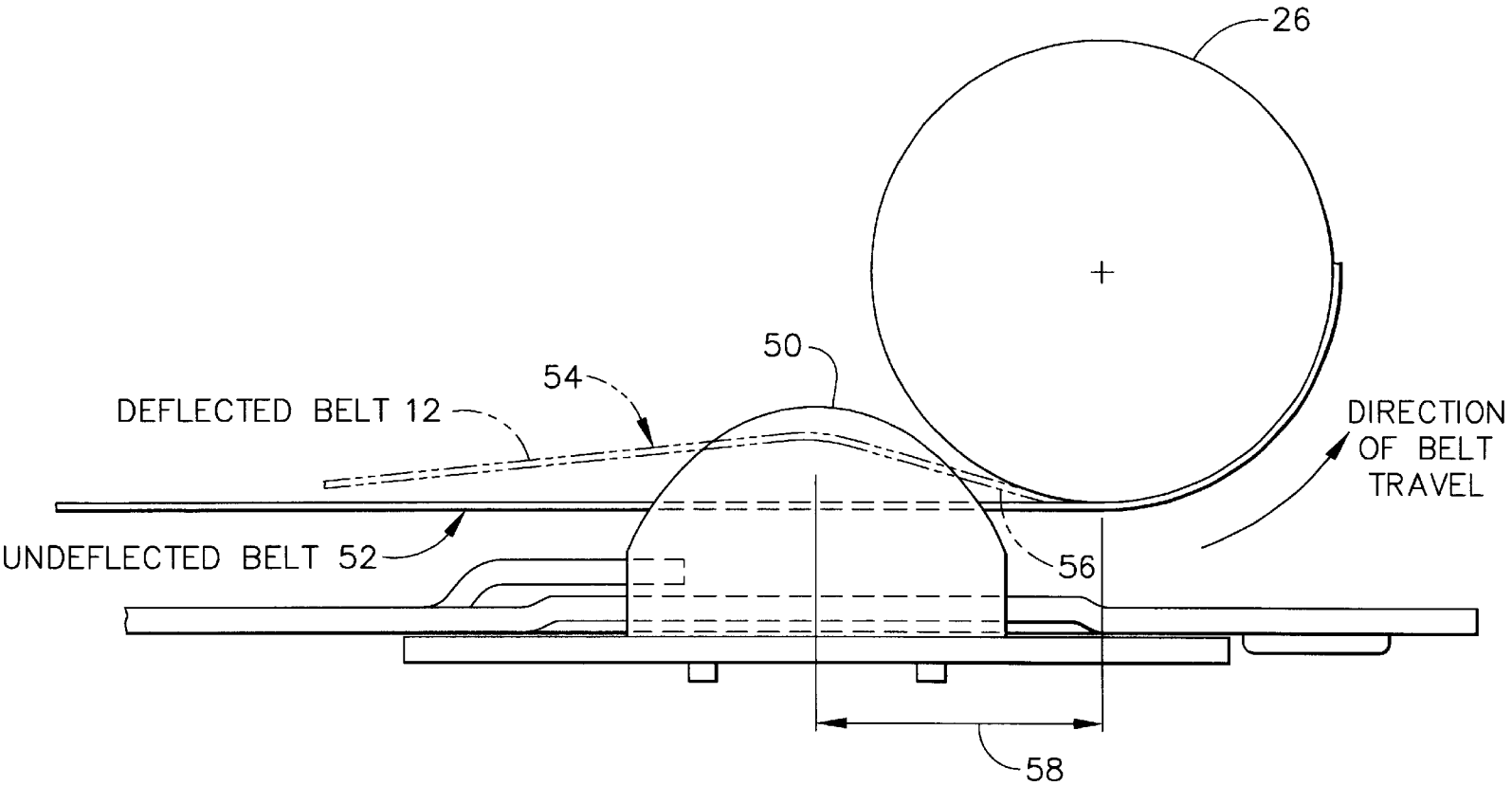
FIG. 2 is an elevational view of a portion of the ITM module of FIG. 1, showing one of the tracking guides in place near the tension roll.

Another aspect of the present invention is the use of angled tracking guides to reduce lateral movement of the belt 12. These angled guides act as deflectors which are positioned within a predetermined relatively small distance from the tension roll 26. The "front" guide is viewable on FIG. 1 at the reference numeral 50. These "deflectors" or "tracking guides" are positioned so as to be in contact with areas of the belt 12 next to the two edges of the belt on the entrance side to the tension roll 26. FIG. 2 illustrates a side view of the front guide 50, while FIG. 4 illustrates a perspective view of both the front guide 50 and a "rear" guide 80.

The tracking guides 50 and 80 are adjustable (as discussed below in greater detail) such that their separation (see dimension 88 on FIG. 4) and their center distance to the tension roll 26 (see dimensions 58 and 82 on FIG. 4 or FIG. 2) can be manipulated at time of manufacture. On FIG. 2, it can be seen that the ITM belt 12, if allowed to travel directly to the tension roll 26 without a guide 50 being in the way, would travel along the line designated by the reference numeral 52. However, with the guide 50 in place, the surface near the outer edge of the area near the edge of ITM belt 12 comes into contact with guide 50 and thereby causes ITM belt 12 to be deflected upward, so that belt 12 travels along the line segments 54 and 56 before reaching the roll 26, although the belt edge curves between those line segments 54, 56.

Figure 4:
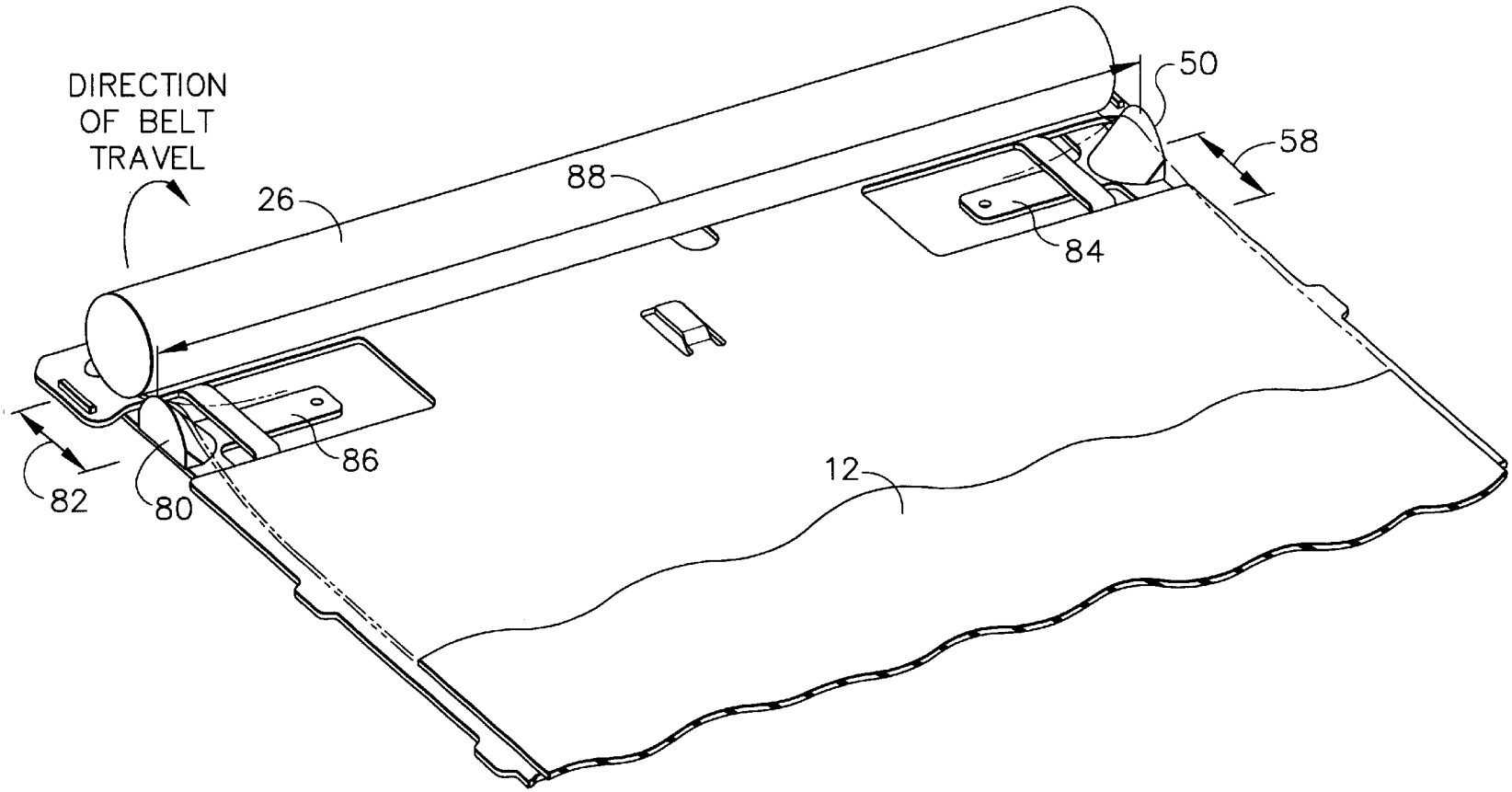
FIG. 4 is a cut-away perspective view of a portion of the ITM module of FIG. 1, showing the tension roll and both angled tracking guides, and their adjustment members.

The perspective view of FIG. 4 shows the preferred shapes of the tracking guides 50 and 80. The area of the guides 50, 80 that touch the belt 12 are a curved surface portion of a cylinder tilted at an angle of about 45° from the horizontal, and which is parallel to a vertical plane that contains the centerline of the tension roll 26. The radius of the cylinder is chosen so as to be large enough to not overstress the portion of the belt 12 that wraps partially around the guides 50, 80, and preferably is about 11 mm in the illustrated embodiment. Angles other than 45°, but larger than 0° and less than 90°, will also be suitable in some applications, for example in the range of 15°–75°. It is preferred that the tracking guides 50 and 80 both remain in contact with the belt 12 at all times. The amount of engagement between guides and belt should be chosen so that tracking behavior is adequate while not overstressing the belt 12 near its edge.

It will be understood that the tracking guides 50 and 80 could be constructed of a shape other than a cylindrical section, without departing from the principles of the present invention. For example, the guides could have a surface geometry that is circular, elliptical, or parabolic, or perhaps a combination of angular surfaces. Moreover, the guides could be constructed of a single piece of material, or of several parts that are assembled.

As the belt 12 proceeds into the tension roll 26, the tracking guides 50 and 80 act on the belt in such a manner as to oppose lateral motion away from the center of the roll 26. As the belt 12 attempts to move laterally, further from the center of the roll in one direction, it must attempt to "climb" up the appropriate angled tracking guide. The surface of this particular guide (50 or 80) deflects that portion of the belt then in contact with the guide. This deflection creates a "local angle" between the portion of the belt 12 contacting against the guide surface and the portion of the belt 12 contacting the roll 26. This local angle is such that it tends to steer the belt 12 back toward the center of the roll 26. The belt 12 will thus move laterally until its tendency to move in that outward direction is cancelled by the "restoring" tendency produced by the angled tracking guide 50 or 80. This restoring action thereby causes the belt 12 to maintain a generally stable lateral position. Since a surface region of the belt is always in contact with the particular guide 50 or 80, the force necessary to produce the steering action is spread over a relatively large region. Due to this large contact region, many stiff and fragile belts can be used without damage. Also, since there is surface contact (and not merely "edge" contact), the belt's position is not affected by small amounts of unevenness in the edge of the belt; in a preferred embodiment, up to 0.3 mm variation is allowable along the belt's edge.

In a preferred embodiment, a "specified small distance" represents the position which the guides 50 and 80 must maintain relative to the tension roll 26; this "specified small distance" is in the range of only about ±0.35 mm tolerance from an optimal position each for the height, separation, and center distance dimensions.

Since this "specified small distance" may be smaller than part or assembly tolerances can economically accommodate, the tracking guides 50 and 80 preferably are made adjustable, and during manufacture are adjusted to the optimal positions in both the process direction and the scan direction. (See 84 and 86 on FIG. 4.)

It is preferred to optimize the position of the tracking guides 50 and 80. The position and tolerance of the two guides, (height, center distance to roll, and separation from one another), is preferably set to maximize the ability to control the belt's lateral motion, while at the same time to not exceed a maximum level of stress on the area of belt surface that is in contact with the guides 50, 80. It has been determined that the closer the guides are nominally positioned to the tension roll 26, the less sensitive the belt tracking is to various (e.g., positional, environmental, or mechanical) disturbances. Such disturbances can be classified as external factors such as: (a) frame rack (which may change the angular alignment of the roll); (b) toner contamination (which may change the friction between the belt and the rollers, and may change the effective diameter of a portion of a roll); and (c) frictional variation over life between the tension roll slider 46 and the ITM module side plate (which may change the belt tension).

The acceptable levels of belt stress (imparted from the guides 50, 80 onto the belt 12), depend on the belt's modulus of elasticity and flex life, and generally is determined by empirical techniques. The position of the tracking guides 50, 80 can be chosen from a number of combinations of height, separation, and center distance to the tension roll 26. The trend of the preferred positions is such that, the smaller the center distance, the lower the guide height. It has also been determined that, when the guides 50, 80 are placed too closely to the roll 26 (for a specified height), there is a higher probability of premature failures such as belt cracks at the edges and excessive belt edge rippling (typically caused by stretching of the belt edge region relative to the main body of the belt).

Both edge rippling and edge cracks of the belt 12 can affect the tracking performance and cleaning capability of the ITM module 10. Given the additional constraint that the tension roll 26 be allowed to float horizontally to accommodate belt length variations, it has been determined that it is best to adjust the tracking guides in the horizontal (i.e., process) direction relative to the tension roll 26, to maintain a proper level of restoring tendency, without allowing premature failures. FIG. 4 illustrates some of the details of the adjustment hardware for the tracking guides, including adjustable slide plates 84 and 86, upon which the guides 50 and 80 mount, respectively.

The nominal guide position and tolerances in one preferred implementation of the present invention are as follows: tracking guide height=17.12 mm±0.25 mm from the top of the guide to the top of the tension roll 26; separation 88 of tracking guides=234 mm±0.25 mm from the back of one guide (e.g., 50) to the back of the other guide (e.g., 80); center distance to the tension roll 26=13.8 mm±0.25 mm. Using 11 mm radius guides, these nominal guide position values ret in a nominal 0.65 mm radial gap from the closest point of the guides 50 or 80 to the surface of the tension roll 26.

As described above, the walk rate of the belt 12 has been minimized, and tracking guides 50 and 80 have been provided to determine the final lateral position of the belt 12 in the module, and are adjustable in the process direction. However, to allow for a compact ITM system 10, the position of the belt 12, as stabilized by the angled tracking guides 50, 80, will need to be near a desired position relative to a specified side plate member of the frame assembly. This is accomplished by moving both tracking guides 50, 80 (as a pair) in the scan direction, which is predominantly parallel to the tension roll axis. In this manner, the absolute position of the average belt edge may be adjusted to the desired position, with a tolerance of ±0.20 mm, thereby minimizing the required clearances between the belt edge and the structural members of the ITM module 10.

The angled tracking guides work well with belts that do not readily conform to contoured rollers. In the preferred arrangement of the present invention, the belt edge itself is not used, but instead a portion of the belt surface near the edge is used. Since this configuration maintains a larger surface area of the belt 12 in contact with the guides than would the actual belt edge, a larger initial walk force can be handled without reinforcement of the belt itself. The form and placement of the guides 50, 80 thus allows the belt's lateral tendency to be controlled without damage to the belt 12. The proximity to the roll 26, the exact shape of the guides, and the material of the guides are determined so as to be compatible with the belt material, system forces, and system configuration.

It will be understood that other configurations of tracking guides used in an ITM belt module could be designed without departing from the principles of the present invention. For example, the guides could exhibit various other surface geometries, such as circular or elliptical geometries, and could exhibit angles other than listed above. Other similar tracking guides could even make use of a parabolic shape, rather than use of a simple angle as described above. The individual guides may be constructed of a single unitary piece of material, or alternatively made of several pieces that are joined during manufacture.

Figure 5:
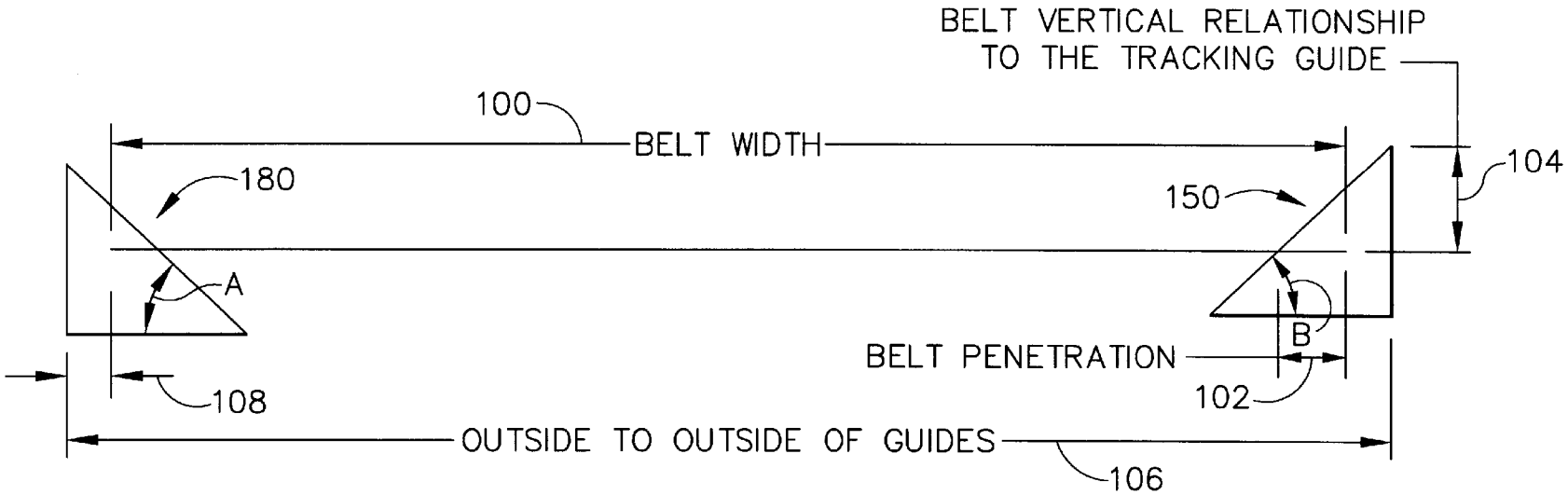
FIG. 5 is a diagrammatic view of the dimensional relationship of the angled tracking guides with respect to the transfer belt of the ITM module of FIG. 1.

The tracking guides 50, 80 are positioned to provide an initial interference (or penetration) between the belt and the guides, which ensures adequate control of belt position, without damage to the belt. This interference/penetration preferably is designed into the dimensions of the parts, so that it is not made adjustable. In the present invention, the term "penetration" is defined as the interference of the undeflected belt into the tracking guide. The outside-to-outside dimension of the tracking guides (for an ITM belt width of 229.9 mm) preferably is set to 234.0 mm±0.25 mm. Using nominal vertical and process guide positions, this provides a nominal belt penetration of 2.89 mm. FIG. 5 illustrates this feature.

In FIG. 5, the overall belt width is designated by the reference numeral 100. The triangle 150 represents schematically the tracking guide 50, while the triangle 180 represents schematically the tracking guide 80. The angles "A" and "B" represent the sloped surfaces of the tracking guides 80 and 50, respectively, as viewed when looking down the length of the belt (i.e., in the process direction). The dimension 104 represents the vertical distance between the top of the tracking guides and the undeflected belt 12.

The "outside-to-outside" dimension of the tracking guides 50, 80 is represented by the reference numeral 106, and the horizontal dimension 108 represents the distance from the outermost portion of the guide 80 and the edge of the undeflected belt. This nominally is a preferred distance of about 2.05 mm. The horizontal dimension 102 represents the "interference" distance of the belt 12 on the tracking guide 50.

Some of the important features of the present invention described above can be summarized as follows:

(1) The ITM belt module 10 of the present invention is constructed to attain roll alignment/parallelism to a reference roll (such as the drive roll 20) within 0.04° to 0.10° (depending on the individual rollers) to minimize the effect of external forces on belt walk rate (i.e., the lateral tendency of the belt). Examples of the external forces are: changes in torque characteristics of the ITM module over its life, or frame rack of the ITM module in EP machines. This parallelism aspect minimizes the lateral tendency of the belt throughout the life of a long-life belt module (e.g., rated for 100,000 revolutions or more), and especially tends to make the belt tracking position insensitive to variations in the torque required to drive the belt system.

(2) The ITM belt module 10 of the present invention is constructed to attain roll conicity/flare to a preferred maximum in the range of 0.020 mm to 0.030 mm diametral variation over each roll to minimize the effect of external forces on the belt walk rate.

(3) The ITM belt module 10 of the present invention allows adjustment of the angle of a roller to obtain a final walk rate of less than 10 $\mu$m per revolution, which will allow angled tracking guides to control the belt position for a long-life module, and over a range of EP machine tolerances and conditions. The present invention can control the lateral position of the belt without edge reinforcement and without the use of actuators.

(4) The ITM belt module 10 of the present invention provides angled tracking guides to control the lateral position of the belt. The tracking guides should exhibit an angle of about 45°, but other angles could be used, within about ±30° or more. Furthermore, the guides are positioned at about 0.65 mm ±0.4 mm of the entrance of a roller (a "radial gap") and positioned axially along the rollers to obtain a specified belt lateral position.

(5) The ITM belt module 10 of the present invention provides angled tracking guides to control the lateral position of the belt, such that the distance between each tracking guide and roller is adjusted to a specified dimension, e.g., 13.8 mm±0.25 mm in the preferred implementation, as part of the assembly and tracking adjustment procedures. The distance is set individually for each guide.

(6) The ITM belt module 10 of the present invention provides angled tracking guides to control the lateral position of the belt, such that the two guides are also adjusted laterally as a pair to obtain the desired final lateral position of the belt, as part of the assembly and tracking adjustment procedures.

(7) The above-described angled tracking guides produce a substantially stable lateral belt position which is not affected by a variation in the belt edge straightness up to 0.3 mm. The result is the ability to maintain an acceptable lateral belt position, over the life of a long-life belt module (e.g., for 100,000 revolutions or more).

(8) The ITM belt module 10 of the present invention provides the ability to effectively clean residual toner from the entire belt width, thereby eliminating the possibility of toner contamination from an area that is otherwise unswept by the cleaner. This feature also allows for a smaller width for both the belt module and EP machine. It will be understood that a belt module that transports print media (e.g., paper sheet) will also benefit from the capability to clean toner from the entire belt width.

(9) The lack of moving parts will increase reliability of the belt tracking system, as compared to an active tracking system.

It will be understood that the precise dimensions and shapes of the various components of the ITM module 10 could be altered without departing from the principles of the present invention. Moreover, the location and order of placement of the various rolls of the ITM module 10 could easily be modified to achieve similar or identical results as those taught in this patent document. Furthermore, the exact type of ITM module that utilizes the inventive concepts described above could be other than one having a toner transport belt, and also could be a belt module used on equipment other than EP printers.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A belt system having a passive tracking system, said system comprising:

a continuous belt member which travels along a predetermined pathway that is formed by a plurality of rolls;

at least one stationary, non-compliant tracking guide that is positioned a predetermined distance from one of the plurality of rolls, wherein said at least one tacking guide tends to limit a lateral movement of said belt member as the belt travels along its predetermined pathway.

2. The system as recited in claim 1, wherein said belt member exhibits no attachments that assist tracking.

3. The system as recited in claim 1, wherein said belt member transports toner from at least one EP member to a transfer station that deposits said toner onto a print medium.

4. The system as recited in claim 1, wherein said belt member transports a print medium past at least one EP member, such that toner is deposited upon said print medium by said at least one EP member.

5. The system as recited in claim 1, further comprising a cleaner station having a cleaning device; wherein said belt member exhibits no attachments that assist tracking, and wherein said belt member's surface is cleaned by said cleaning device across substantially its entire width.

6. A belt system having a passive tracking system, said system comprising:

a continuous belt member which travels along a predetermined pathway that is formed by a plurality of rolls;

at least two tracking guides that are positioned a predetermined distance from one of the plurality of rolls, wherein said at least two tracking guides tend to limit a lateral movement of said belt member as the belt travels along its predetermined pathway, and wherein said at least two tracking guides comprise at least one pair of individual racking guides positioned along outer longitudinal edges of said belt, and wherein said tracking guides are adjustable such that, during a setup procedure: (a) said predetermined distance from one of the plurality of rolls is adjusted, (b) a distance between said tracking guides is adjusted, and (c) a lateral position of the tracking guides as a pair is adjusted.

7. The system as recited in claim 6, wherein said tracking guides are positioned at an angle with respect to a plane of movement of said belt, and wherein said angle is in the range of about 45°±30°.

8. The system as recited in claim 6, wherein said two individual tracking guides are adjusted individually so as to exhibit a predetermined distance between each of the tracking guides and said one of the plurality of rolls, wherein said predetermined distance varies when a dimension of said tracking guides varies.

9. A belt system having a passive tracking system, said system comprising:

a continuous belt member which travels along a predetermined pathway that is formed by a plurality of rolls; and wherein at least two of said plurality of rolls are positioned in stationary locations such that their parallelism is maintained in a predetermined substantially small angular value, to minimize an effect of external forces on belt walk rate in a lateral direction.

10. The system as recited in claim 9, wherein said parallelism produces a roll misalignment of no more than about 0.04° to 0.10°.

11. A belt system having a passive tracking system, said system comprising:

a continuous belt member which travels along a predetermined pathway that is formed by a plurality of rolls; and wherein at least one of said plurality of rolls exhibits a roll conicity/flare of a predetermined maximum diametral variation within a roll, along the entire width of the roll so as to maintain a substantially uniform diameter along said at least one of said plurality of rolls, thereby reducing a walk rate of said continuous belt member.

12. The system as recited in claim 11, wherein, said predetermined maximum diameter variation comprises a maximum value of about 0.030 mm over the entire width of each roll within a particular intermediate transfer member system.

13. A belt system having a passive tracking system, said system comprising;

a continuous belt member which travels along a predetermined pathway that is firmed by a plurality of rolls, said plurality of rolls comprising a drive roll, a back-up roll, a reverse roll, and a tension roll;

said drive roll and said tension roll being located at first and second ends of said predetermined pathway, said backup roll and said reverse roll being located in a position between said first and second ends and causing said predetermined pathway to exhibit a substantial re-direction at said position between said first and second ends; and wherein, during a set-up procedure, a position of said reverse roll is adjusted along a predetermined path so as to minimize the belt walk rate in a lateral direction.

14. The system as recited in claim 13, further comprising a cam that is in physical contact with a linear slider that is in physical contact with a shaft of said reverse roll, wherein said cam is rotated to effect said adjustment to the position of said reverse roll.

15. The system as recited in claim 13, wherein said roll adjustment produces a walk rate of less than 10 $\mu$m per revolution of said belt.

16. A method for controlling lateral movement of a belt member in a belt system, said method comprising:

providing a belt system having a continuous belt member which travels along a predetermined pathway that is formed by a plurality of rolls;

controlling dimension tolerances of predetermined components of said system;

adjusting a position of a first of said plurality of rolls with respect to a second of said plurality of rolls, thereby tending to minimize a walk rate of said belt member as the belt member travels along its predetermined pathway; and providing at least one stationary, non-compliant tracking guide that is positioned a predetermined distance from one of the plurality of rolls, wherein said at least one tracking guide tends to limit the lateral movement of said belt member as the belt member travels along its predetermined pathway.

17. The method as recited in claim 16, wherein said step of adjusting the position of said first roll comprises: adjusting a cam which contacts a linear slider that is in physical contact with a shaft of said first roll, wherein said cam is rotated to effect said adjustment to the position of said first roll.

18. The method as recited in claim 16, wherein said step of adjusting the position of said first roll sets a walk rate to less than about 10 $\mu$m per revolution of said continuous belt member.

19. The method as recited in claim 16, wherein said step of controlling dimension tolerances of predetermined components of said system comprises: selecting at least one of said plurality of rolls that exhibit a roll conicity/flare of a predetermined maximum diametral variation of about 0.030 mm over the entire width of the roll.

20. The method as recited in claim 16, wherein said predetermined distance between said at least one tracking guide and said one of the plurality of rolls varies when a dimension of said at least one tracking guide varies.

21. The method as recited in claim 16, wherein said belt member exhibits no attachments that assist tracking; and further comprising: cleaning said belt member's surface across substantially its entire width by use of a cleaning device.

22. The method as recited in claim 16, wherein said at least one tracking guide deflects at least one edge of said belt member at all times.

23. A method for controlling lateral movement of a belt member in a belt system, said method comprising:

providing a belt system having a continuous belt member which travels along a predetermined pathway that is formed by a plurality of rolls;

controlling dimension tolerances of predetermined components of said system;

adjusting a position of a first of said plurality of rolls with respect to a second of said plurality of rolls, thereby tending to minimize a walk rate of said belt member as the belt member travels along its predetermined pathway; and providing at least one tracking guide that is positioned a predetermined distance from one of the plurality of rolls, wherein said at least one tracking guide tends to limit the lateral movement of said belt member as the belt member travels along its predetermined pathway;

wherein said at least one tracking guide comprises a pair of tracking guides, one positioned on either edge of said belt member; the pair of tracking guides being positioned at an angle with respect to a plane of movement of said belt member, and wherein said angle is in the range of about 45°±30°.

* * * * *